United States Patent [19]

Ogi et al.

[11] 4,268,621

[45] May 19, 1981

[54] DIRECT POSITIVE PHOTOGRAPHIC MATERIAL

[75] Inventors: Keiji Ogi; Takashi Sasaki; Kenichiro Okaniwa; Yasuo Tosaka, all of Hino, Japan

[73] Assignee: Konishiroku Photo Industry Co., Ltd., Tokyo, Japan

[21] Appl. No.: 61,400

[22] Filed: Jul. 27, 1979

[30] Foreign Application Priority Data

| | | | |
|---|---|---|---|
| Jul. 29, 1978 | [JP] | Japan | 53-92809 |
| Nov. 14, 1978 | [JP] | Japan | 53-140135 |
| Nov. 14, 1978 | [JP] | Japan | 53-140137 |

[51] Int. Cl.[3] ..... G03C 5/24; G03C 1/06

[52] U.S. Cl. ..... 430/409; 430/378; 430/547; 430/551; 430/564; 430/607; 430/613; 430/599; 430/600

[58] Field of Search ..... 430/551, 547, 607, 613, 430/599, 600, 564, 566, 409, 378

[56] References Cited

U.S. PATENT DOCUMENTS

| | | | |
|---|---|---|---|
| 2,165,421 | 9/1936 | Sheppard et al. | 430/607 |
| 2,466,957 | 4/1949 | Lewis | 242/55.3 |
| 2,497,875 | 2/1950 | Fallesen | 430/409 |
| 2,588,982 | 3/1952 | Ives | 430/409 |
| 2,735,765 | 2/1956 | Loria et al. | 430/551 |
| 3,227,552 | 1/1966 | Whitmore | 430/239 |
| 3,236,652 | 2/1966 | Kennard et al. | 430/607 |
| 3,432,300 | 3/1969 | Lestina et al. | 430/551 |
| 3,761,266 | 2/1950 | Milton | 430/409 |
| 3,761,276 | 9/1973 | Evans | 430/547 |
| 3,796,577 | 3/1974 | Collier et al. | 430/406 |
| 4,021,248 | 5/1977 | Shiba et al. | 430/551 |
| 4,121,939 | 10/1978 | Adachi et al. | 430/551 |
| 4,138,259 | 2/1979 | Adachi et al. | 430/607 |
| 4,174,220 | 11/1979 | Taguchi et al. | 430/551 |

FOREIGN PATENT DOCUMENTS

| | | | |
|---|---|---|---|
| 1151363 | 5/1969 | United Kingdom | 430/409 |

*Primary Examiner*—Won H. Louie, Jr.

*Attorney, Agent, or Firm*—Finnegan, Henderson, Farabow, Garrett & Dunner

[57] ABSTRACT

A light-sensitive silver halide photographic material of internal latent image type for use in the formation of a direct positive image containing a compound of the following general formula (I) or (II):

General formula (I)

General formula (II)

The photographic material can be developed after a shortened induction period, can yield good positive images that are free from stain when undergoing fogging development, and can yield good direct positive images with a high maximum density and a low minimum density. The photographic material forms a direct positive image when subjected, after imagewise exposure, to an overall light exposure or development in the presence of a fogging agent and can be developed by surface development.

9 Claims, No Drawings

DIRECT POSITIVE PHOTOGRAPHIC MATERIAL

BACKGROUND OF THE INVENTION

This invention relates to a light-sensitive, direct positive silver halide photographic material, more particularly to a light-sensitive silver halide photographic material of internal latent image type containing a novel, development-accelerating compound, as used for the formation of a direct positive image by imagewise exposure followed by exposing overall to light before and/or during development, or developing in the presence of a fogging agent.

The present invention provides an art which can be applied also to color diffusion transfer besides ordinary black-and-white photography and color photography. It is well known that a direct positive photographic image can be formed by using a light-sensitive silver halide photograhic material but without requiring any intermediate treatment step or formation of a negative photographic image.

Known methods which have heretofore been employed in order to form a positive image by using a light-sensitive, direct positive type, silver halide photographic material can be classified, excepting specific ones, primarily into two types, in view of the practical usefulness.

According to one of the above two types, a silver halide emulsion which has previously been fogged is used and fog nucleus (latent imge) at the exposed portion is destroyed by the utilization of a solarization or Herschel effect to yield a positive image after development.

According to the another type, a silver halide emulsion of internal latent image type, which has not been fogged is used and, subsequent to imagewise exposure, surface development is effected after and/or during fogging treatment to yield a positive image. In the present specification the surface development effected after and/or during the fogging treatment is referred to as "fogging development" hereinafter. The above fogging treatment may be effected by applying overall exposure to light, by using a fogging agent, by using a strong developer or by effecting heat treatment, but ordinarily a method comprising utilization of light or a fogging agent is adopted. Further, the silver halide photographic emulsion of internal latent image type means such silver halide photographic emulsion that possesses a sensitive speck primarily within the silver halide grains and forms a latent image within said grains by exposure.

In comparison with the former type method, the latter type method is generally higher in the sensitivity and thus suitable for an application where high sensitivity is required. This invention relates in particular to this latter type method.

In the field of this art, a variety of arts have been known heretofore. Those which are principal can be seen in, for example, U.S. Pat. Nos. 2,592,250, 2,466,957, 2,497,875, 2,588,982, 3,761,266, 3,761,276 and 3,796,577 and British Pat. No. 1,151,363. According to these known processes, it is possible to prepare a light-sensitive photographic material having a relatively high sensitivity for a direct positive type.

With regard to a detail of the mechanism of forming a direct positive image, it cannot be said that definite explanation has been given but, for example, referring to "Internal-Image Desensitization" as discussed in "The Theory of the Photographic Process", by C.E.K. Mees and T. H. James, third edition, page 161, the course of the formation of a positive image can be understood to certain degree. Thus, it is considered that by virtue of the surface desensitization due to the so-called internal latent image which is formed within silver halide grains by the first imagewise exposure, fog nucleus is selectively formed only on the surface of unexposed silver halide grains and then a photographic image is formed in the unexposed portion by surface development.

In order to selectively nucleate as above, there has been known to give uniform light-exposure over the whole surface or to use as the fogging agent a hydrazine compound or a heterocyclic quaternary nitrogen salt compound.

However, in the application of these methods where a direct positive image is formed by the use of light or a fogging agent to a variety of photographic fields, there are retained further technical problems which should be improved. For example, in such fogging development, fogging by virtue of light or a fogging agent must be preceded prior to a development reaction in order to nucleate fog nucleus, which induce the development reaction and consequently the induction period until the time when development reaction is initiated is longer in comparison with the ordinary development of latent image silver, and as the result, the development rate is considerably delayed. Accordingly, when applied, in particular, to light-sensitive multi-layer color photographic material, there are caused such problems that unevenness in the sensitometry characteristics is liable to be caused between layers. Furthermore, the finally obtainable maximum density is relatively low.

As a method for increasing the maximum density in the color diffusion transfer process using a direct positive silver halide emulsion, use of a hydroquinone sulfonic acid derivative is described in U.S. Pat. No. 3,227,552. However, in the case where such compound is used together, the following disadvantage has been found to be caused. When a positive image is formed by using the above-mentioned hydroquinone sulfonic acid derivative together with a fogging agent, it was found that the background portion was outstandingly discolored to blue and stained, although the maximum density of the image finally obtained was increased. Such staining not only damages the background portion of a photographic image but also particularly degrades the quality of color image when applied to color photography and consequently such problem becomes one which may be said disadvantageous.

SUMMARY OF THE INVENTION

An object of this invention is to provide an excellent light-sensitive silver halide photographic material of internal latent image type for use in the formation of a direct positive image, wherein the afore-mentioned problems in the prior art have been solved. Another object of this invention is to provide a light-sensitive silver halide photographic material of internal latent image type for use in the formation of a direct positive image, which is rapidly processed in the fogging development and free from stain. More in detail, the object of this invention is to provide a light sensitive silver halide photographic material of internal latent image type, which is developed after a shortened induction period, causes no stain in the background portion in the fogging development for a relatively short period of time and yields a good direct positive image wherein the maximum density is high and the minimum density is low.

As a result of extensive researches, the inventors found that the afore-mentioned objects could be achieved by means of a light-sensitive silver halide photographic material of internal latent image type for use in the formation of a direct positive image, containing a compound of the following general formula [I] or [II] (said compound being referred to hereinafter simply as compound of this invention):

General formula [I]

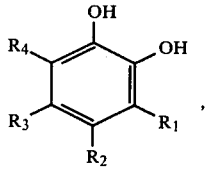

General formula [II]

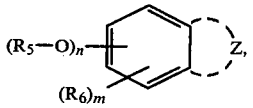

wherein $R_1$ represents a hydrogen atom, a hydroxyl group or an alkyl, alkenyl, alkoxy, acyloxy, aralkyl or aryl group which is substituted or unsubstituted; $R_2$, $R_3$ and $R_4$ each represent a hydrogen atom, a halogen atom, $—SO_2R_7$, $—COR_8$, or an alkyl, alkenyl, alkoxy, aralkyl or aryl group which is substituted or unsubstituted; $R_5$ represents a hydrogen atom, $—COR_7$ or $—SO_2R_7$, and when n is 2 or 3, $R_5$ may be same or different; $R_6$ represents a hydrogen atom, a halogen atom or an alkyl, alkoxy, aryl or alkenyl group which may be substituted, and when m is 2, $R_6$ may be same or different; Z represents an atomic group necessary to complete a 5 to 7-membered alkylene ring, or a chroman or coumaran ring by fusing together with benzene ring, and Z may have a spyro carbon atom; $R_7$ represents a hydroxyl group, or an alkyl, alkoxy, aryloxy or amino group which is substituted or unsubstituted; n is 2 or 3; m is a number obtained by subtracting n from 4; and $R_8$ represents hydrogen atom, hydroxyl group, or an alkyl, alkoxy, aryloxy or amino group which is substituted or unsubstituted, with the proviso that at least one of $R_1$, $R_2$, $R_3$ and $R_4$ is not a hydrogen atom.

DESCRIPTION OF THE PREFERRED EMBODIMENTS

In the general formulae, a halogen atom includes, for example, fluorine, chlorine, bromine or iodine; an alkyl group includes, those may be straight or branched and preferably contains 1-32 carbon atoms, for example, methyl, ethyl, n-butyl, tert.-butyl, 2-ethyl-hexyl, 3,5,5-trimethylhexyl, 2,2-dimethylpentyl, n-octyl, tert.-octyl, n-dodecyl, sec.-dodecyl, n-hexadecyl, n-octadecyl or eicosyl group; an alkoxy group includes, for example, methoxy, ethoxy, n-propoxy, n-butoxy, tert.-butoxy, n-hexoxy, n-dodecoxy or n-octadecoxy group; and an aryl group includes, for example, phenyl or naphthyl group; an aralkyl group includes, for example, benzyl or phenethyl group; an aryloxy group includes, for example, phenoxy, α-naphthoxy, p-methylphenoxy, p-methoxyphenoxy, p-acetamidophenoxy, o-chlorophenoxy or m-nitrogphenoxy group; an aralkoxy group includes, for example, benzyloxy or phenethyloxy group; an alkyloxycarbonyl group includes, for example, ethoxycarbonyl, tert.-butoxycarbonyl or octadecylcarbonyl group; and an aryloxycarbonyl group includes, for example, phenoxycarbonyl, p-methylphenoxy-carbonyl, p-methoxyphenoxy-carbonyl, p-acetamidophenoxycarbonyl or p-chlorophenoxycarbonyl group.

Further, each of the above groups may carry a substituent and such substituent includes, for example, a halogen atom, hydroxyl group, carboxyl group, alkyl group (particularly one having 1-32 carbon atoms), alkenyl group (particularly one having 2-32 carbon atoms), alkoxy group, aryl group, aryloxy group, arylamino group, alkyloxycarbonyl group or aryloxycarbonyl group. These substituents may further be substituted by such substituents as mentioned above.

Among the compounds of the general formula [I], compounds of the following general formula [I-1] and [I-2], respectively, are included as those which are preferable in the present invention:

General formula [I-1]

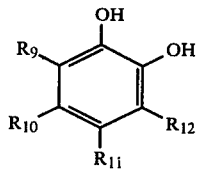

General formula (I-2]

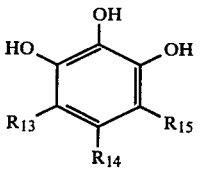

In each of the above-formulae, $R_9$ to $R_{15}$ have the same meanings as defined for $R_2$, $R_3$ and $R_4$ in the general formula [I]. Further, preferably hydrogen atom, halogen atom, carboxyl group, or alkyl, alkoxy, aryl, aralkyl, alkoxycarbonyl, carboxyalkyl, aminocarbonyl or alkylaminocarbonyl group which is substituted or unsubstituted is included as preferable group for $R_9$ to $R_{15}$.

As the alkyl group, one containing 1-32 carbon atoms is preferable and further preferably the alkyl group contains 1-20 carbon atoms. However, at least one of $R_9$, $R_{10}$, $R_{11}$ and $R_{12}$ in the general formula [I-1] and at least one of $R_{13}$, $R_{14}$ and $R_{15}$ in the general formula [I-2] is not hydrogen atoms.

As a further preferable compound of the general formula [I], there is included also a compound of the following general formula [I-3]:

General formula [I-3]

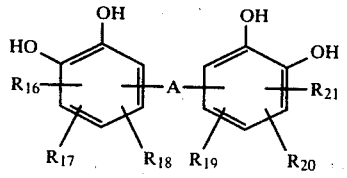

wherein $R_{16}$ to $R_{21}$ have the same meanings as defined for $R_2$, $R_3$ and $R_4$ in the general formula [I], and $R_{16}$, to $R_{21}$ may be hydrogen atoms in all.

The symbol A represents a simple bond or an alkylene group which may be straight or branched and preferably contains 1–12 carbon atoms.

The compounds represented by the general formula [I] of this invention are in general commercially available or can easily be synthesized according to a method described in a literature such as Journal of Chemical Society, Perkin 1, 1972, page 2286, Journal of Chemical Society, 1930, page 793, etc.

Among the compounds represented by the general formula [II], a compound preferably used in this invention is represented by one of following general formulae [II-1] to [II-6 ]:

General formula[II-1]

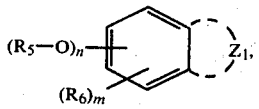

General formula [II-2]

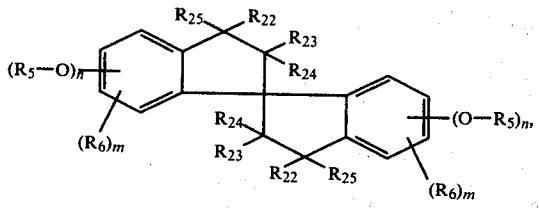

General formula [II-3]

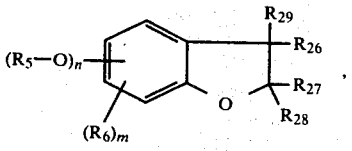

General formula [II-4]

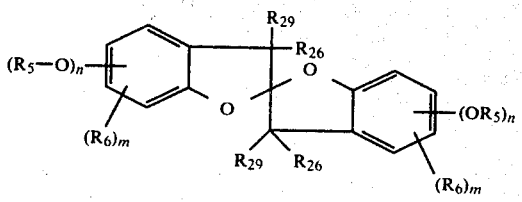

General formula [II-5]

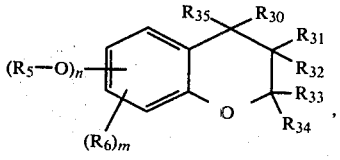

General formula [II-6]

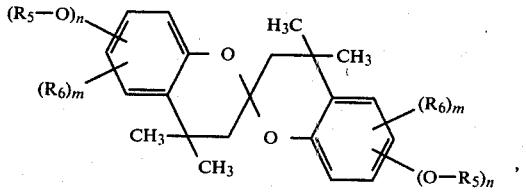

wherein $Z_1$ represent an atomic group necessary to complete a 5 to 7-membered alkylene ring, $R_{22}$ to $R_{35}$ each represent a hydrogen atom, a halogen atom or an alkyl or aryl group which may be substituted.

More particularly, in the general formulae [II-1] to [II-6] each $R_6$ is preferably an alkyl group which is straight or branched and contains 1–18 carbon atoms each of $R_{30}$ to $R_{35}$ is preferably an alkyl group which is straight or branched and contains 1–18 carbon atoms, more preferably 1–4 carbon atoms, and each of $R_{24}$, $R_{25}$, $R_{26}$ and $R_{29}$ is preferably hydrogen atom or an alkyl group which is straight or branched and contains 1–4 carbon atoms. More preferably, $R_5$ is hydrogen atom, $R_{22}$ and $R_{25}$ are each methyl group and $R_{23}$ and $R_{24}$ are each hydrogen atom.

Furthermore, the substituents $(O—R_5)_n$ on the aromatic ring are preferably attached at positions adjacent to each other.

These compounds represented by the general formula [II] can readily be synthesized according to a process disclosed, for example, in European Polymer Journal, 7, 255–261 (1971), Journal of Chemical Society, 1678–1681 (1934) and ibid., 2511–2524 (1930) or U.S. Pat. Nos. 3,432,300 or 2,746,871 .

Concrete exemplification of a compound of the general formula [I] or [II] will be given below, without any intention of limiting the present invention thereto.

(1)

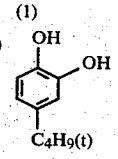

(2)

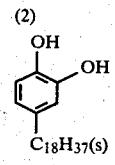

(3)

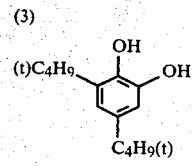

(4)

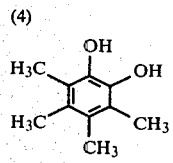

(5)

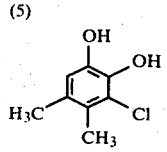

(6)

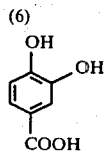

-continued
(7)
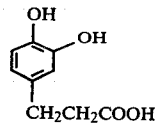
(8)
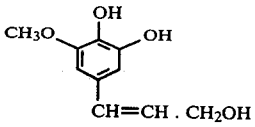
(9)
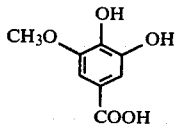
(10)
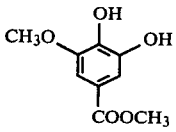
(11)
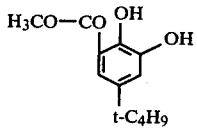
(12)
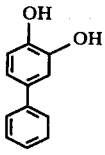
(13)
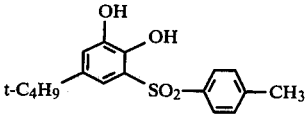
(14)
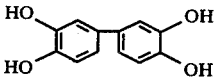
(15)
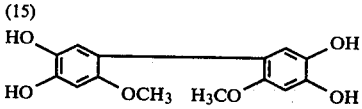
(16)
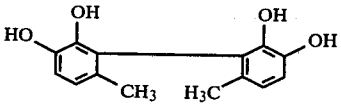
(17)
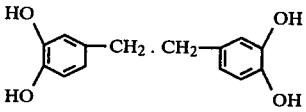
(18)
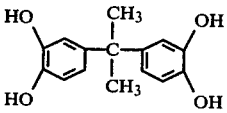
(19)
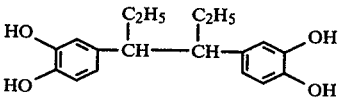
(20)
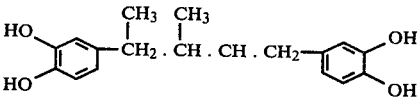
(21)
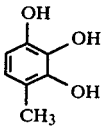
(22)
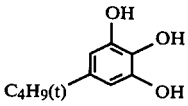
(23)
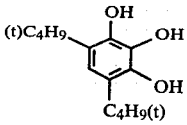
(24)
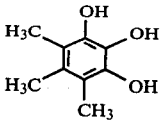
(25)
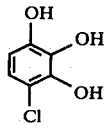
(26)
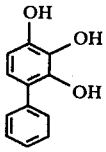
(27)
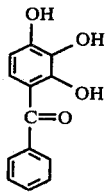
(28)
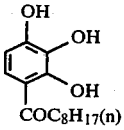
(29)
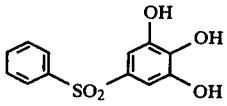
(30)
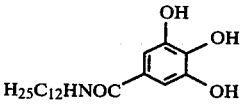
(31)
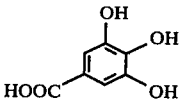
(32)
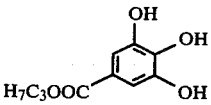
(33)
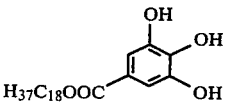
(34)
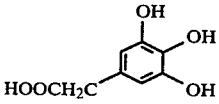
(35)
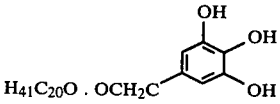
(36)
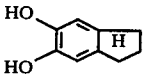
(37)
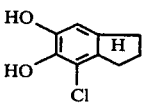
(38)
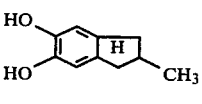
(39)
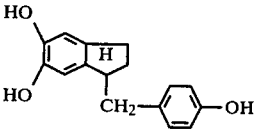
(40)
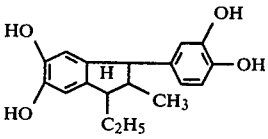

-continued
(41)
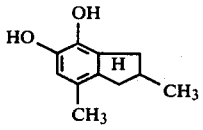
(42)
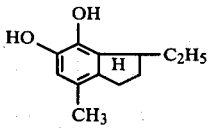
(43)
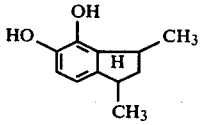
(44)
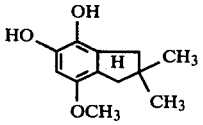
(45)
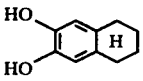
(46)
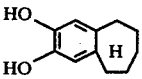
(47)
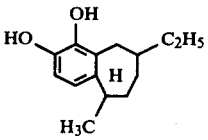
(48)
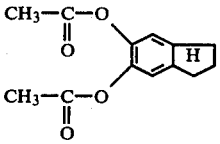
(49)
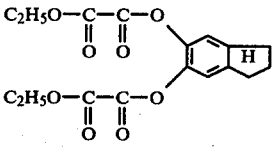
(50)
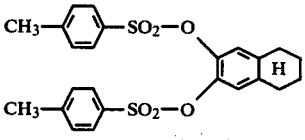
(51)
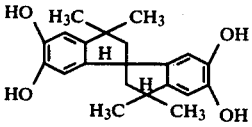
(52)
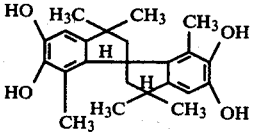
(53)
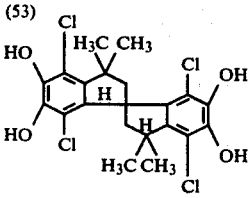
(54)
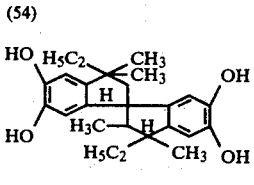
(55)
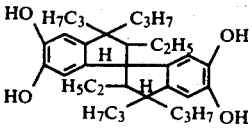
(56)
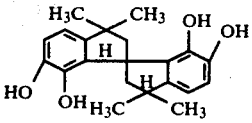
-continued
(57)
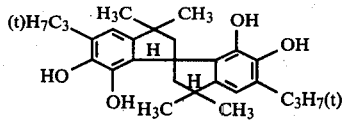
(58)
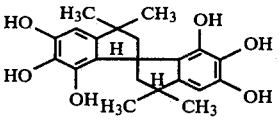
(59)
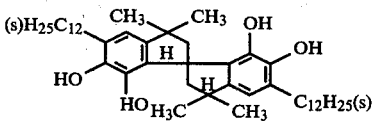
(60)
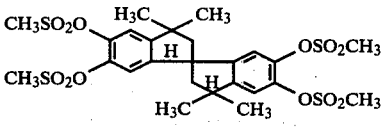
(61)
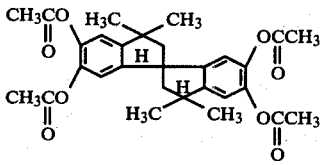
(62)
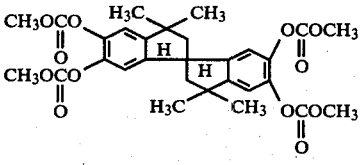
(63)
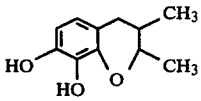
(64)
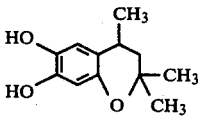
(65)
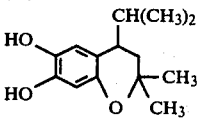
(66)
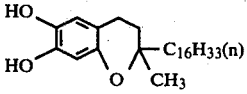

-continued
(67)
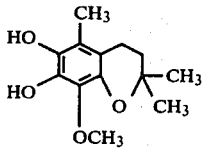
(68)
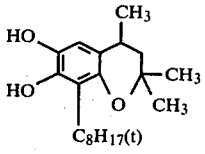
(69)
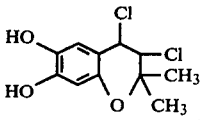
(70)
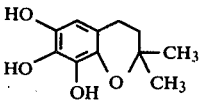
(71)
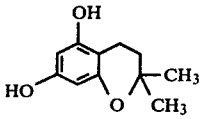
(72)
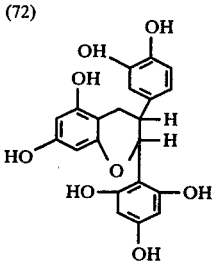
(73)
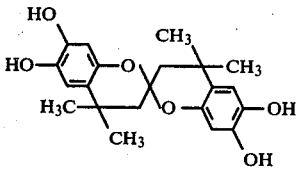
(74)
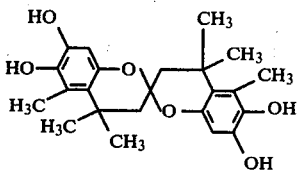
(75)
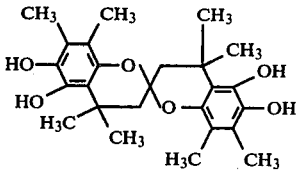
(76)
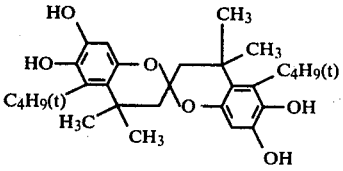
-continued
(77)
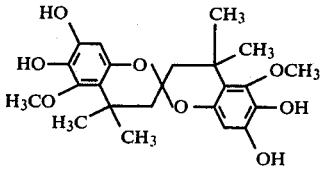
(78)
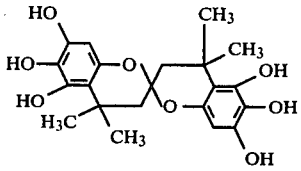
(79)
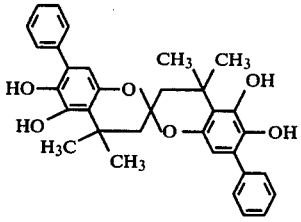
(80)
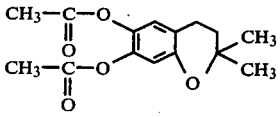
(81)
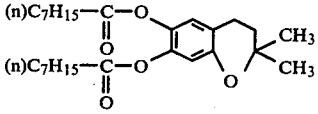
(82)
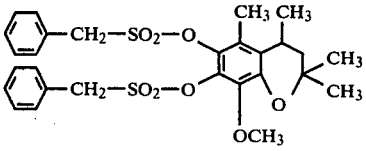
(83)
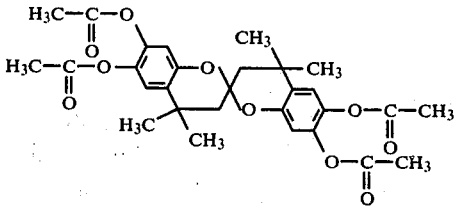

-continued (84)

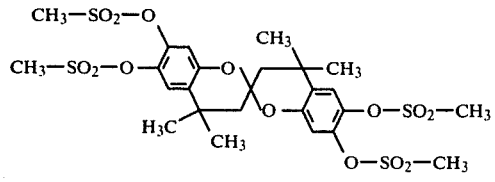

(85)

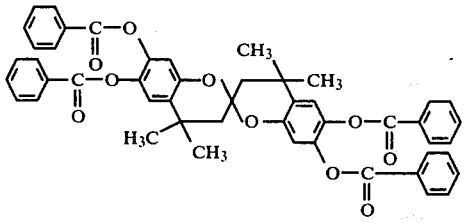

(86)

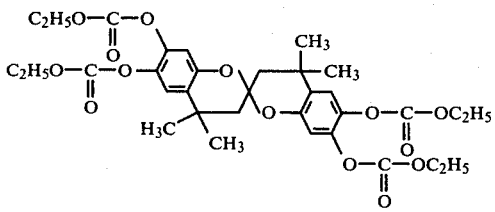

A compound of this invention may be included in any layer constituting a light-sensitive silver halide photographic material of internal latent image type, preferably in the silver halide emulsion layer and/or at least one of the photographic constructive layers other than silver halide emulsion layer existing at the emulsion layer side on the support, more preferably in the silver halide emulsion layer and/or an adjacent layer thereto, and particularly preferably in the silver halide emulsion layer.

The content of a compound of this invention may be such amount that is satisfactory for accelerating the fogging development when development treatment is effected by subjecting the light-sensitive silver halide photographic material of internal latent image type to light-exposure or in the presence of a fogging agent. An amount to be actually added may vary over a braod range depending upon the characteristic features of the light-sensitive silver halide photographic material used or development condition. When a compound of this invention is included in the silver halide emulsion, an amount of 0.001–1 mol per mol of silver halide is preferable and particularly an amount of 0.001–0.5 mol is preferable. Further, when included in a layer adjacent to said silver halide emulsion layer, an amount to be added may be such as being in accordance with that to be added when the compound of this invention is included in the silver halide emulsion layer. Further, the time when the compound of this invention is added may be any suitable time after completion of ripening of the silver halide emulsion and before coating thereof, when included in said emulsion layer, or any suitable time from the preparation of coating liquid until coating is made, when included in a layer other than said silver halide emulsion layer.

A compound of this invention is added in the form of a solution in an appropriate solvent such as, for example, water, alcohols, acetone, benzene or dioxane. Further, among compounds of this invention, those which are soluble in oil are in general preferably dissolved and dispersed in a high boiling solvent according to a process described in U.S. Pat. Nos. 2,322,027, 2,801,170, 2,801,171, 2,272,191 and 2,304,940, if necessary, by using together a low boiling solvent and then added to a hydrophilic colloidal solution. In this case, if necessary, an oleophilic photographic additive such as coupler may be dispersed together and included in a photographic constituent layer such as the silver halide emulsion layer, without causing any injurious effect. Furthermore, a compound of this invention can readily be dispersed according to also a dispersion method using a latex solution as described in U.S. Pat. Nos. 2,269,158, 2,852,382, 2,772,168, 3,619,195 and 2,801,170. Further, among compounds of this invention, those which are soluble in an alkali (or which are soluble in water) can also be added to the hydrophilic colloidal solution in the form of an alkaline solution (or an aqueous solution).

In the present invention, the principal step for forming a direct positive image comprises effecting the surface development after and/or during the fogging treatment applied, after the imagewise exposure to an unfogged, light-sensitive silver halide photographic material of internal latent image type. Said fogging treatment can be carried out by subjecting to light-exposure or by using a fogging agent.

In the present invention, the exposure is carried out by dipping or wetting a light-sensitive material which has been subjected to the imagewise exposure in or with a developer or other aqueous solution and then subjecting said material to the uniform exposure overall to light. As the light source to be used for this, any light may be used so far as it is included within the wavelength range to which said light-sensitive material is susceptible. Alternatively, a light of high intensity such as flash light may be applied for a short period of time or a weak light may be applied for a long period of time. The time during which the whole surface exposure is effected can be varied over a wide range depending upon a type of the light-sensitive material used, development condition or a type of light source used so that finally the best positive image can be obtained.

As the fogging agent to be used in the present invention, compounds over a broad range of type can be used and the fogging agent may be present at the time when the development is effected. Thus, the fogging agent may be included, for example, in the light-sensitive silver halide photographic material of internal latent image such as silver halide emulsion layer or in the developer or a processing solution prior to the development and conveniently in the light-sensitive silver halide photographic material (and especially in the silver halide emulsion layer). The amount of the fogging agent used can be varied over a range depending upon the objects and a preferable amount to be added is, when it is added to the silver halide emulsion layer, 1–1500 mg per mol of silver halide and an amount of 10–1000 mg is particularly preferable. Further, when added to a processing liquid such as developer, a preferable amount to be added is 0.01–5 g/liter, particularly 0.05–1 g/liter.

The fogging agent used in this invention includes, for example, hydrazines as described in U.S. Pat. Nos.

2,563,785 and 2,588,982; hydrazide or hydrazone compounds as described in U.S. Pat. Nos. 3,227,552; heterocyclic quaternary nitrogen salt compounds as described in U.S. Pat. Nos. 3,615,615, 3,718,470, 3,719,474, 3,734,738 and 3,759,901; and acylhydrazinophenylthioureas as described in U.S. Pat. No. 4,030,925. Further, these fogging agents can be used in combination. For example, Research Disclosure No. 15162 suggests the use of a combination of a non-adsorption type fogging agent and an adsorption type fogging agent.

Examples of useful fogging agent include hydrazine compounds such as hydrazine hydrochloride, phenylhydrazine hydrochloride, 4-methyl-phenylhydrazine hydrochloride, p-methylsulfonamidethylphenylhydrazine, 1-formyl-2-phenylhydrazine, 1-acetyl-2-phenylhydrazine, 1-acetyl-2-(4-methylphenyl)hydrazine, 1-acetyl-2-(4-acetamidophenyl)hydrazine, 1-methylsulfonyl-2-phenylhydrazine, 1-benzoyl-2-phenylhydrazine, 1-lauroyl-2-phenylhydrazine, 1-methylsulfonly-2-(3-phenylsulfonamidophenyl)hydrazine, formaldehyde phenylhydrazine, aceton-4-methylphenylhydrazine, 1-sulfomethyl-2-phenylhydrazine, 1-sulfomethylamino-2-phenylhydrazine, etc.; N-substituted quaternary cycloammonium salts such as 3-(2-formylethyl) -2-methylbenzothiazolium bromide, 3-(2-acetylethyl)-2-ethylbenzothiazolium bromide, 3-(2-acetylethyl)-2-benzylbenzothiazolium bromide, 3-(2-formylethyl)-2-propylbenzothiazolium bromide, 5-chloro-3-(2-formylethyl)-2-methylbenzothiazolium bromide, 3-(2-acetylethyl)-2-benzylbenzoselenazolium bromide, 3-(2-acetylethyl-2-benzyl-5-phenyl-benzoxazolium bromide, 2-methyl-3-[3-(phenylhydrazono)- propyl]benzothiazolium bromide, 2-methyl-3-[3-(p-tolylhydrazono)propyl]benzothiazolium bromide, 2-methyl-3-[3-(p-sulfophenylhydrazono)propyl]benzothiazolium bromide, 2-methyl-3-[3-(p-toluenesulfonylhydrazono)pentyl]naphtho-[2, 1-b]thiazolium iodate, 2-methyl-3-[3-(p-sulfophenylhydrazono)pentyl]benzothiazolium iodate, 1,2-dihydro-3-methyl-4-phenylpyrid[2,1-b]benzothiazolium bromide, 1,2-dihydro-3-methyl-4-phenylpyrid[2,1-b]-5-phenylbenzoxazolium bromide, 1,2-dihydro-3,4-dimethylpyrid[2,1-b]benzothiazolium bromide, 4,4'-ethylenebis(1,2-dihydro-3-methylpyrid[2,1-b]-benzothiazolium bromide), 1,2-dihydro-3-methyl-4-phenylpyrid[2,1-b]benzoselenazolium bromide etc.; 5-[1-ethylnaphtho-(1,2-b)thiazolin-2-ylidene ethylidene]-1-(2-phenylcarbazoyl)-methyl-3-(4-sulfamoylphenyl)-2-thiohydantoin, 5-(3-ethyl-2-benzothiazolinilidene)-3-[4-(2-formylhydrazino)phenyl]-rhodanine, 1-[4-(2-formylhydrazino)phenyl]-3-phenylthiourea and 1,3-bis[4-(2-formylhydrazino)phenyl]thiourea.

The light-sensitive silver halide photographic material of internal latent image type, containing a compound of this invention forms a direct positive image when it is subjected after the imagewise exposure to an overall light exposure or the development in the presence of a fogging agent. As the method of developing the light-sensitive silver halide photographic material according to this invention, any development method may be adopted and preferably the surface development is employed. This surface development means the processing with a developer which is substantially free from any solvent for silver halide.

As the ordinary silver halide developing agent which can be used in the developer of this invention, there can be included polyhydroxybenzenes such as hydroquinone, aminophenols, 3-pyrazolidone, ascorbic acid and its derivatives, reductones, phenylenediamines or a mixture thereof. Specifically, there are included hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamidethyl)aniline, 4-amino-3-methyl-N-ethyl-N-(β-hydroxyethyl)-aniline, etc. These developing agents may previously be impregnated in the emulsion and then made to act on the silver halide during being dipped in an aqueous solution of high pH value.

The developer used in this invention is able to contain further a particular anti-fogging agent and development inhibitor, or alternatively these additives to the developing solution can optionally be incorporated into the layer of the light-sensitive silver halide photographic material. An anti-fogging agent which is ordinarily useful includes, for example, benzotriazoles such as 5-methylbenzotriazole, benzothiazoles such as 5-methylbenzothiazole; 1-phenyl-5-mercaptotetrazoles, heterocyclic thions such as 1-methyl-2-tetrazoline-5-thion; and aromatic and aliphatic mercapto compounds.

The light-sensitive silver halide photographic material of internal latent image type according to the present invention comprises at least one silver halide emulsion layer of internal latent image type. The silver halide emulsion of internal latent image type according to the present invention is such emulsion that forms a latent image predominantly inside of the silver halide grains. In the emulsion, any silver halide, for example, silver bromide, silver chloride, silver chlorobromide, silver iodobromide or silver chloroiodobromide may be included.

Particularly preferably, the afore-mentioned emulsion is one which exhibits, when a part of the sample thereof coated on a transparent support is subjected to exposure with a light intensity scale for a fixed period of time up to about 1 second and then to the development with a surface developer. A surface developer having the composition as given below, which contains substantially no solvent for silver halide and develops only a latent image formed on the surface of the grains, at 20° C. for 4 minutes, such maximum density that is not greater than one-fifth of the maximum density obtainable by subjecting another part of the same emulsion sample as above to the same exposure and to the development with an internal developing solution B having the composition as given below, which develops a latent image formed inside of the grains, at 20° C. for 4 minutes. Preferably, the maximum density obtained by using the surface developer A is not greater than one-tenth of that obtained by using the internal developer B.

Surface Developer A:

| | |
|---|---|
| Metol | 2.5 g |
| L-Ascorbic acid | 10 g |
| $NaBO_2 \cdot 4H_2O$ | 35 g |
| KBr | 1 g |
| Water to make up | 1 liter |

Internal Developer B:

| | |
|---|---|
| Metol | 2.0 g |
| Sodium sulfite (anhydrous) | 90.0 g |
| Hydroquinone | 8.0 g |
| Sodium carbonate monohydrate | 52.5 g |
| KBr | 5.0 g |
| KI | 0.5 g |

-continued

| | |
|---|---|
| Water to make up | 1 liter |

The silver halide emulsions of internal latent image type according to this invention include those prepared by various processes. Such emulsions are, for example, the conversion type silver halide emulsion as described in U.S. Pat. No. 2,592,250, the silver halide emulsion containing silver halide particles in which have been subjected to internal chemical sensitization as described in U.S. Pat. Nos. 3,206,316, 3,317,322 and 3,367,778, the silver halide emulsion containing silver halide particles which a polyvalent metal ion is occluded as described in U.S. Pat. Nos. 3,271,157, 3,447,927 and 3,531,291, the silver halide emulsion in which the surface of silver halide grains containing a dopant has been weakly chemically sensitized as described in U.S. Pat. No. 3,761,276, the silver halide emulsion which has a layered grain structure as described in U.S. Pat. Nos. 3,935,014 and 3,957,488 or the silver halide emulsion containing silver iodide prepared according to the ammonia method as described in Japanese Patent Pre-Examination Publication No. 52-156614.

Further, it is possible to include in the silver halide emulsion of internal latent image type according to the present invention a compound containing an azaindene ring and a nitrogen-containing heterocyclic compound containing mercapto group in an amount of 1 mg to 10 g per mol of the silver halide to give a more stable result which has a lower minimum density.

As the compound containing azaindene ring, 4-hydroxy-6-methyl-1,3,3a,7-tetrazaindene is preferable. As the nitrogen-containing heterocyclic compound containing mercapto group, a pyrazole ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, a ring formed by fusion of 2 or 3 rings of the above rings, for example, a triazolotriazole ring, diazaindene ring, triazaindene ring, tetrazaindene ring, pentazaindene ring, etc., phthalazinone ring and indazole ring are included, and one preferable is 1-phenyl-5-mercaptotetrazole.

Further, in the present invention, for example, a mercury compound, triazole series compound, azaindene series compound, benzothiazolium series compound or zinc compound can be used as the anti-fogging agent or stabilizing agent.

Furthermore, it is optionally effected to add various photographic additives to the silver halide emulsion of internal latent image type according to the present invention. For example, as the optical sensitizer usable in the present invention, there are included cyanines, merocyanines, 3- or 4-nuclear merocyanines, 3- or 4-nuclear cyanines, styryls, polopolacyanines, hemicyanines, oxonols and hemioxonols, and these optical sensitizers preferably contain as the nitrogen-containing heterocyclic nucleus the basic residue of thiazoline, or the nucleus of rhodanine, thiohydantoin, oxazolidinedione, barbituric acid, thiobarbituric acid or pyrazolone. These nuclei may further be substituted by an alkyl, hydroxyalkyl, sulfoalkyl, carboxyalkyl, halogen, phenyl, cyano or alkoxy group and furthermore optionally condensed with a carbocyclic or heterocyclic ring.

The silver halide emulsion of internal latent image type according to this invention can be supersensitized. Reference to the method of the supersensitization can be found, for example, in "Review of Supersensitization" (Photographic Science and Engineering) Vol. 18, page 4418 (1974).

Other additives used in this invention depending upon objects include, for example, a dihydroxyalkane as the wetting agent, a water-dispersible high molecular weight compound in the form of fine grain, which is obtained by emulsion polymerization of a copolymer of an alkyl acrylate or alkyl methacrylate and acrylic acid or methacrylic acid, styrenemaleic acid copolymer or styrene-maleic anhydride half alkyl ester copolymer suitable as the improver of physical properties of film and, for example, saponin, polyethylene glycol lauryl ether as the coating aid. Further, it is optionally effected to use as other photographic additives, a gelatin plasticizer, surfactant, UV-absorber, pH conditioner, antioxidant, antistatic agent, viscosity-increasing agent, granularity improver, dye, mordant, brightening agent, development modifier and matting agent.

The silver halide emulsion thus prepared is coated on a support, if necessary, through a subbing layer, antihalation layer or filter layer to give a direct positive, light-sensitive silver halide photographic material.

Use of the light-sensitive silver halide photographic material of internal latent image type according to the present invention for color photography is useful and in this case, a cyan, magenta and yellow dye image forming couplers are preferably included in the silver halide photographic emulsion.

Said yellow dye image forming coupler includes those of benzoylacetanilide type, pivaloylacetanilide type or 2-equivalent type wherein the carbon atom at the position where the coupling takes place is substituted by a substituent which can be split off when the coupling reaction takes place (so-called a split off group), said magenta dye image forming coupler includes those of 5-pyrazolone series, pyrazolotriazole series, pyrazolinobenzimidazole series, indazolone series or 2-equivalent type containing the so-called split off group and said cyan dye image forming coupler includes those of phenol series, naphthol series, pyrazoloquinazolone series or 2-equivalent type containing the split off group.

Further, in order to prevent fading of a dye image due to actinic light of short wavelength, use of a UV absorber, for example, thiazolidone, benzotriazole, acrylonitrile or benzophenone series compound is useful and, in particular, use of Tinuvin PS, ibid. 320, ibid. 326, ibid. 327 or ibid 328 (all being products of Ciba-Geigy) alone or in combination with one another is convenient.

As the support for the light-sensitive silver halide photographic material of internal latent image type according to the present invention, any one may be used and representative supports include polyethylene terephthalate film, polycarbonate film, polystyrene film, polypropylene film, cellulose acetate film, glass, baryta paper, polyethylene laminate paper, etc., if necessary subbed.

In the light-sensitive silver halide photographic material of internal latent image type according to the present invention, an appropriate gelatin derivative can be included in addition to gelatine depending upon object for which said material is used. Such appropriate gelatin derivative can include, for example, acylated gelatin, guanidylated gelatine, carbamylated gelatin, cyanoethanolated gelatin and esterified gelatin.

Further, in the present invention, other hydrophilic binder can be included depending upon objects and as appropriate binders are included, in addition to gelatin, colloidal albumin, agar, gum arabic, dextran, arginic acid, a cellulose derivative such as cellulose acetate hydrolyzed up to 19–20% of the content of acetyl, polyacrylamide, polyacrylamideimidation product, casein, vinyl alcohol polymer containing urethane carboxylic acid group or cyanoacetyl group such as vinyl alcohol-vinylaminoacetate copolymer, polyvinyl alcohol, polyvinyl pyrrolidone, hydrolyzed polyvinyl acetate, a polymer obtainable by the polymerization of protein or saturated acylated protein and monomer having vinyl group, polyvinyl pyridine, polyvinyl amine, polyaminoethyl methacrylate, polyethylene amine, etc. These binders can be added, depending upon objects, to a constructive layer of light-sensitive silver halide photographic material, such as emulsion layer, inter layer, protective layer, filter layer or back layer, and in the above-mentioned hydrophilic binder, an appropriate plastic agent or wetting agent can be included depending upon objects.

Furthermore, constituent layers of the light-sensitive silver halide photographic material can be hardened with any appropriate hardening agent. Such hardening agents include a chromium salt, zirconium salt and hardening agents of aldehyde series such as formaldehyde or mucohalogenic acid, halotriazine series, polyepoxy compound, ethyleneimine series, vinyl sulfon series and acryloyl series.

Moreover, it is possible to apply on the support of the light-sensitive silver halide photographic material according to the present invention a number of various photographic constructive layers such as an emulsion layer, filter layer, inter layer, protective layer, sublayer, back layer, antihalation layer, etc.

The light-sensitive silver halide photographic material according to the present invention can effectively be applied to various uses as for general black-and-white photograph, X-ray photograph, color photograph, pseudocolor photograph, printing photograph, infrared photograph, microphotograph, silver dye-bleaching photograph, and also to the colloid transfer method, silver salt diffusion transfer method and the color image transfer method, color diffusion transfer method, absorption transfer method, etc., as described in U.S. Pat. Nos. 3,087,817, 3,185,567 and 2,983,606 issued to Rogers, U.S. Pat. No. 3,253,915 issued to Weiyerts et al., U.S. Pat. No. 3,227,550 issued to Whitmore et al., U.S. Pat. No. 3,227,551 issued to Pearl et al., U.S. Pat. No. 3,227,552 issued to Whitmore, and U.S. Pat. Nos. 3,415,664, 3,415,645 and 3,415,646 issued to Land.

This invention will be exemplified in the following Examples but the embodiments of the present invention will not be limited by these Examples.

EXAMPLE 1

According to the method described in Example 1 of U.S. Pat. No. 2,592,250, a silver chloroiodobromide emulsion of internal latent image type based on the conversion method was prepared.

Further, the compounds (1), (9), (19) and (21) of this invention were dissolved in 5 ml of dibutyl phthalate (DBP) and 10 ml of ethyl acetate (EA) and the resulting solution was emulsified and dispersed in 100 ml of a 5% aqueous gelatin solution containing sodium dodecylbenzenesulfonate. Then, the emulsified solution thus obtained was added to 1 liter of the above emulsion (containing 0.35 mol of silver chloroiodobromide) and as the hardening agent, 30 ml of a 4% aqueous 2,4-dichloro-6-hydroxy-5-triazine sodium solution was added. Thereafter, the resulting emulsion was coated on a cellulose acetate support so that the amount of coated silver might be 35 mg/100 $cm^2$, and then dried. Separately, a sample in which no compound of this invention was added was prepared as a comparative sample in a similar way.

These samples were subjected to wedge exposure and development with a developer [I] having the following formulation was effected at 20° C. for 1 minute, 3 minutes and 4 minutes, and then fixing, washing with water and drying were effected:

Developer [I]

| | |
|---|---|
| Phenidone | 0.4 g |
| Sodium sulfite (anhydrous) | 75 g |
| Hydroquinone | 10 g |
| Sodium carbonate (monohydrate) | 40 g |
| Potassium bromide | 4 g |
| 5-Methylbenzotriazole | 10 mg |
| 1-Formyl-2-phenyl-hydrazine | 1 g |
| Water to make up | 1 liter |
| (pH Being adjusted to 12.5 with sodium hydroxide.) | |

Results of the positive images thus obtained are shown in Table 1.

TABLE 1

| Sample No. | Added compound, and its amount (g) | Developing time (Min.) | Maximum Density | Minimum Density |
|---|---|---|---|---|
| 1 | Exemplified compound (1), 2 | 1 | 0.69 | 0.07 |
| | | 3 | 0.89 | 0.10 |
| | | 4 | 0.99 | 0.11 |
| 2 | Exemplified compound (9), 2 | 1 | 0.62 | 0.06 |
| | | 3 | 0.80 | 0.10 |
| | | 4 | 0.91 | 0.10 |
| 3 | Exemplified compound (20), 2 | 1 | 0.71 | 0.07 |
| | | 3 | 0.91 | 0.10 |
| | | 4 | 0.99 | 0.11 |
| 4 | Exemplified compound (22), 2 | 1 | 0.81 | 0.07 |
| | | 3 | 0.97 | 0.10 |
| | | 4 | 1.05 | 0.11 |
| 5 | Exemplified compound (65), 2 | 1 | 0.68 | 0.06 |
| | | 3 | 0.89 | 0.09 |
| | | 4 | 1.07 | 0.11 |
| 6 | Exemplified compound (73), 2 | 1 | 0.79 | 0.01 |
| | | 3 | 0.97 | 0.09 |
| | | 4 | 1.21 | 0.11 |
| 7 | None | 1 | 0.29 | 0.06 |
| | | 3 | 0.48 | 0.09 |
| | | 4 | 0.62 | 0.11 |

From the results shown in the above Table 1, it is noted that even when development using a fogging agent is effected, Samples containing the compounds of this invention form more rapidly good positive images wherein the maximum density is outstandingly increased and the minimum density is low, in comparison with Comparative Sample.

EXAMPLE 2

A solution of 39 g of 1-(2,4,6-trichlorophenyl)-3-(2-chloro-5-octadecylsuccinimidoanilino)-5-pyrazolane as magenta coupler and a compound of this invention as specified in Table 2 given later in 30 ml of DBP and 75 ml of EA was added to 500 ml of a 5% aqueous gelatin solution containing sodium dodecylbenzenesulfonate and emulsified and dispersed therein.

Then, each of the resulting emulsified solution was added to 1 liter of the same silver halide emulsion of internal latent image type (containing 0.35 mol of silver chloroiodobromide) as used in Example 1, mixed and 25 ml of 5% acetone solution of tetrakis(vinylsulfonylmethyl) methane as the hardening agent was added, and the resulting emulsion was coated on a cellulose triacetate support so that the coated amount of silver might be 200 mg/100 $cm^2$ and then dried.

For comparison, a sample in which the compound of this invention was omitted from the afore-mentioned sample (Comparative Sample - 1) and a sample in which potassium 2-octadecylhydroquinone-5-sulfonate (Compound A) disclosed in U.S. Pat. No. 3,227,552 was added in place of the compound of this invention were prepared in a similar manner as above.

After being subjected to wedge exposure, these samples were developed with the developer [II] of the following formulation:

Developer [II]

| | |
|---|---|
| 4-amino-3-methyl-N-ethyl-N-(α-methanesulfonamidoethyl)-aniline sulfate | 5 g |
| sodium sulfite (anhydrous) | 2 g |
| trisodium phosphate | 40 g |
| benzimidazole | 50 ml |
| 1-acetyl-2-phenyl hydrazine | 1 g |
| water to make up (pH being adjusted to 12.0 with sodium hydroxide) | 1 liter |

at 20° C. for 5 minutes, and thereafter bleached, fixed, washed with water and then dried according to an ordinary manner.

Results on a positive image thus obtained in each sample are shown in Table 2.

As apparent from these results shown in Table 2, samples containing the compounds of this invention are accelerated in the fog development and increased in the maximum density and further it is noted from the comparison on the blue stain concentration within the maximum density area that according to the compounds of this invention, there are obtainable good positive images which are free from stain and have higher maximum density in comparison with the known compound A.

TABLE 2

| Sample No. | Exemplified Compound and its Amount added (g) | | Maximum Density | Minimum Density | Blue Stain Density |
|---|---|---|---|---|---|
| 1 | Exemplified Compound (1) | 2 | 2.70 | 0.10 | 0.00 |
| 2 | Exemplified Compound (3) | 2 | 2.72 | 0.10 | 0.00 |
| 3 | Exemplified Compound (4) | 2 | 2.65 | 0.10 | 0.00 |
| 4 | Exemplified Compound (11) | 2 | 2.56 | 0.10 | 0.00 |
| 5 | Exemplified Compound (14) | 2 | 2.50 | 0.10 | 0.00 |
| 6 | Exemplified Compound (17) | 2 | 2.61 | 0.10 | 0.00 |
| 7 | Exemplified Compound (18) | 2 | 2.63 | 0.10 | 0.00 |
| 8 | Exemplified Compound (20) | 2 | 2.67 | 0.10 | 0.00 |
| 9 | Exemplified Compound (22) | 2 | 2.81 | 0.11 | 0.01 |
| 10 | Exemplified Compound (25) | 2 | 2.47 | 0.10 | 0.00 |
| 11 | Exemplified Compound (31) | 2 | 2.53 | 0.10 | 0.00 |
| 12 | Exemplified Compound (32) | 2 | 2.69 | 0.10 | 0.00 |
| 13 | Exemplified Compound (34) | 2 | 2.51 | 0.09 | 0.00 |
| 14 | Exemplified Compound (65) | 2 | 2.50 | 0.09 | 0.00 |
| 15 | Exemplified Compound (68) | 2 | 2.65 | 0.09 | 0.00 |
| 16 | Exemplified Compound (73) | 2 | 2.33 | 0.10 | 0.23 |
| Comparative Sample-1 | none | 0 | 1.26 | 0.15 | 0.00 |
| Comparative Sample-2 | Compound A | 2 | 2.33 | 0.10 | 0.23 |

EXAMPLE 3

According to the method described in Example 1 of U.S. Pat. No. 2,592,250, a silver chloroiodobromide emulsion (containing 0.35 mol of silver chloroiodobromide) of internal latent image type based on the conversion method was prepared.

Then, a 5% methanol solution of the compound (36), (45) and (48) of the present invention, respectively, was added to 1 liter of the above emulsion. After further addition of 30 ml of a 4% aqueous solution of 2,4-dichloro-6-hydroxy-5-triazine sodium as the hardening agent, the resulting emulsion was coated on a cellulose triacetate support so that the amount of coated silver might be 35 mg/100 $cm^2$ and dried (Samples 2 to 4).

Separately, the compounds (65) and (73) of this invention were dissolved in 5 ml of dibutyl phthalate (DBP) and 10 ml of ethyl acetate (EA), respectively, and the resulting solutions were emulsified and dispersed, respectively, in 100 ml of 5% aqueous gelatin solution containing sodium dodecylbenzenesulfonate. Then, the emulsion and dispersion solution thus obtained was added to 1 liter of the aforementioned silver chloroiodobromide emulsion. After further addition to the emulsion of 30 ml of a 4% aqueous solution of 2,4-dichloro-6-hydroxy-5-triazine sodium salt, the resulting emulsion was coated on a cellulose triacetate support so that the amount of coated silver might be 35 mg/100 $cm^3$ of the support, and then dried (Sample 5 and 6, respectively).

Further, a sample in which no compound of this invention was added was prepared as a comparative sample in a similar manner (Sample 1).

These samples were subjected to exposure through an optical wedge for sensitometry, by using an sensitometer (the exposure of this type referred to hereinafter as wedge exposure), developed with a developing solution having the following formulation at 20° C. for 6 minutes, and fixed, washed with water and dried in an ordinary manner:

| | |
|---|---|
| Metol | 2.5 g |
| l-Ascorbic acid | 10 g |
| $NaBO_2 \cdot 2H_2O$ | 35 g |
| KBr | 1 g |
| Water to make up | 1 liter |

However, until completion of the above development from 30 seconds after the initiation of development, the whole surface was subjected to uniform exposure with 5 lux-light. Results of the positive images thus obtained are shown in Table 3.

TABLE 3

| Sample No. | Compound added and its Amount (g) | Maximum Density | Minimum Density |
|---|---|---|---|
| 1 | None | 0.91 | 0.08 |
| 2 | Compound (36) 5 | 1.18 | 0.08 |
| 3 | Compound (45) 5 | 1.21 | 0.08 |
| 4 | Compound (48) 3 | 2.27 | 0.09 |
| 5 | Compound (65) 2 | 1.26 | 0.08 |
| 6 | Compound (73) 2 | 1.37 | 0.08 |

From the results shown in Table 3, it is noted that Samples containing the compounds of this invention yield good positive images wherein the maximum density is high.

EXAMPLE 4

After the wedge exposure using Samples 1 to 4 as prepared in Example 3, development with developer [I] mentioned above was effected at 20° C. for 1 minute, 3 minutes and 4 minutes, and then fixing, washing with water and drying were effected:

| | |
|---|---|
| Phenidone | 0.4 g |
| Sodium sulfite (anhydrous) | 75 g |
| Hydroquinone | 10 g |
| Sodium carbonate (monohydrate) | 40 g |
| Potassium bromide | 4 g |
| 5-Methylbenzotriazole | 10 mg |
| 1-Formyl-2-phenyl-hydrazine | 1 g |
| Water to make up | 1 liter |
| (pH Being adjusted to 12.5 with sodium hydroxide.) | |

Results of the positive images thus obtained are shown in Table 4.

TABLE 4

| Sample No. | Development Time (min.) | Maximum Density | Minimum Density |
|---|---|---|---|
| 1 (control) | 1 | 0.29 | 0.06 |
| | 3 | 0.48 | 0.9 |
| | 4 | 0.62 | 0.11 |
| 2 | 1 | 0.61 | 0.06 |
| | 3 | 0.83 | 0.08 |
| | 4 | 0.97 | 0.10 |
| 3 | 1 | 0.68 | 0.06 |
| | 3 | 0.90 | 0.09 |
| | 4 | 1.03 | 0.10 |
| 4 | 1 | 0.79 | 0.07 |
| | 3 | 0.98 | 0.09 |
| | 4 | 1.11 | 0.10 |

From the results shown in the above Table 4, it is noted that even when development using a fogging agent is effected, Samples containing the compounds of this invention form more rapidly good positive images wherein the maximum density is outstandingly increased and the minimum density is low, in comparison with Comparative Sample 1.

EXAMPLE 5

A solution of 39 g of 1-(2,4,6-trichlorophenyl)-3-(2-chloro-5-octadecylsuccinimidanilino)-5-pyrazolone as the magenta coupler in 39 ml of dibutyl phthalate and 75 ml of ethylacetate, respectively, was added to 500 ml of a 5% aqueous gelatin solution containing sodium dodecylbenzenesulfonate, and emulsified and dispersed.

Then, each of the resulting emulsion dispersion solutions was added to 1 liter of the same silver halide emulsion of internal latent image type (containing 0.35 mol of silver chloroiodobromide) as used in Example 1 and mixed. Then, a 5% methanol solution of the compounds (36), (38), (45), (48), (49), (54) and (55) of the present invention, respectively, was added. Further, 25 ml of a 5% acetone solution of tetrakis (vinylsulfonylmethyl)methane serving as the hardening agent was added. The resulting emulsion was coated on a cellulose triacetate support so that the amount of coated silver might be 20 mg/100 $cm^2$ and then dried.

Separately, a sample in which no compound of this invention was added was prepared as a comparative sample in a similar manner.

After being subjected to the wedge exposure, these samples were developed at 20° C. for 5 minutes with a developer [IV] having the following formulation:

Developer [IV]

| | |
|---|---|
| 4-Amino-3-methyl-N-ethyl-N-(β-methanesulfonamidethyl)-aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water to make up | 1 liter |

However, for 3 minutes after 30 seconds from the initiation of the above development, the whole surface was subjected to uniform exposure with 1 lux-light. Subsequently, ordinary bleaching, fixing, washing with water and drying were effected.

Results of positive images obtained by each of the above samples are given in Table 5.

TABLE 5

| Sample No. | Exemplified Compound added and its Amount (g/liter of emulsion) | | | Maximum Density | Minimum Density |
|---|---|---|---|---|---|
| 1 | None | | 0 | 1.22 | 0.18 |
| 2 | Exemplified Compound | (36), | 2 | 2.53 | 0.10 |
| 3 | " | (38), | 2 | 2.51 | 0.10 |
| 4 | " | (45), | 2 | 2.64 | 0.10 |
| 5 | " | (48), | 2 | 2.83 | 0.10 |
| 6 | " | (49), | 2 | 2.78 | 0.10 |
| 7 | " | (54), | 2 | 2.70 | 0.10 |
| 8 | " | (55), | 2 | 2.76 | 0.10 |

As apparent from the above results, it is noted that Samples containing the compounds of this invention yield good color positive images in which the fogging development is accelerated to increase the maximum density but the minimum density is low.

EXAMPLE 6

According to Example 5, a sample wherein potassium 2-octadecylhydroquinone-5-sulfonate (Compound A) described in US Patent 3 227 552 was added in place of the compound of this invention was prepared in a similar manner. Samples prepared in Example 5 and the above comparative sample were processed in the same way as mentioned in the Example 2. The result was given in Table 6.

TABLE 6

| Sample No. | Exemplified Compound and its Amount added (g) | | Maximum Density | Minimum Density | Blue Stain Density |
|---|---|---|---|---|---|
| 1 | None | 0 | 1.26 | 0.15 | 0.00 |
| 2 | Exemplified compound (36), | 2 | 2.57 | 0.10 | 0.00 |
| 3 | Exemplified compound (38), | 2 | 2.56 | 0.10 | 0.00 |
| 4 | Exemplified compound (45), | 2 | 2.69 | 0.10 | 0.00 |
| 5 | Exemplified compound (48), | 2 | 2.85 | 0.10 | 0.00 |
| 6 | Exemplified compound (49), | 2 | 2.80 | 0.10 | 0.00 |
| 7 | Exemplified compound (54), | 2 | 2.77 | 0.10 | 0.00 |
| 8 | Exemplified compound (55), | 2 | 2.73 | 0.10 | 0.00 |
| 9 | Exemplified compound A, | 2 | 2.31 | 0.10 | 0.23 |

As apparent from the above results, it is noted that Samples containing the compounds of this invention are increased in the maximum density due to acceleration of development and that, from the comparison in blue stain density within the range of the minimum density, good positive images in which the stain is more decreased and the maximum density is higher than in the known compound are obtainable.

EXAMPLE 7

Samples were prepared in the same way as described in the Example 1 except that the compounds of the present invention were used as shown in the Table 7. The samples were processed in the same manner as Example 5. The result is shown in the Table 7.

TABLE 7

| Sample No. | Exemplified Compound and its Amount added | | Maximum Density | Minimum Density |
|---|---|---|---|---|
| 1 | None | 0 | 1.23 | 0.18 |
| 2 | Exemplified compound (65), | 2 | 2.57 | 0.10 |
| 3 | Exemplified compound (68), | 2 | 2.52 | 0.10 |
| 4 | Exemplified compound (73), | 2 | 2.69 | 0.10 |

As it is clear from the result, Samples containing a compound of this invention have good positive image characteristics of high maximum densities and low minimum densities.

EXAMPLE 8

On a transparent polyethylene terephthalate support, the following layers were applied successively in the order as given below to give a light-sensitive element (Sample No. 1):

(1) Image-receiving layer containing 1:1 copolymer of styrene and N-vinylbenzyl-N,N,N-trihexylammonium chloride (22 mg/100 cm$^2$) and gelatin (22 mg/100 cm$^2$), (2) Light-reflecting layer containing titanium dioxide (22 mg/100 cm$^2$) and gelatin (22 mg/100 cm$^2$), (3) Opaque layer containing carbon black (28 mg/100 cm$^2$) and gelatin (18 mg/100 cm$^2$), (4) Layer containing magenta dye-releasing compound, i.e. 1-hydroxy-4-[3-{α-(2-(2-methoxy-5-sulfamoyl-1-azo)-4-hydroxy-1-naphthoxy)ethylcarbamoyl}-phenylsulfonamido]-N-(δ-2,4-di-tert.-amylphenoxybutyl)-2-naphthamide (17 mg/100 cm$^2$), N,N-diethyllaurylamide (11 mg/100 cm$^2$) and gelatin (25 mg/100 cm$^2$), (5) Light-sensitive emulsion layer containing the same silver chloroiodobromide emulsion of internal latent image type as used in Example 1 (14 mg/100 cm$^2$, calculated on the basis of silver), the compound of this invention (1 mg/100 cm$^2$), DBP (2 mg/100 cm$^2$), 1-formyl-2-phenylhydrazine (0.13 mg/100 cm$^2$) and gelatin (16.5 mg/100 cm$^2$) and (6) Protective layer containing mucochlorid acid (1.0 mg/100 cm$^2$) and gelatin (10.0 mg/100 cm$^2$).

Further, for comparison, a sample which contains in the above light-sensitive layer (5) no compound of this invention was prepared in a similar manner (Comparative Sample).

Then, on a transparent polyethyleneterephthalate film support having 100 μm of thickness, the following layers were coated in the order of succession as given below to prepare a cover sheet.

(1) Neutralization layer of 22.0 μm of dry film thickness containing a copolymer of acrylic acid and ethyl acrylate (75/25% by weight) (220 mg/100 cm$^2$) and (2) Timing layer of 5.0 μm in thickness containing cellulose diacetate (acetylation degree 40%) (50 mg/100 cm$^2$).

Then, the afore-mentioned light-sensitive element was subjected to wedge exposure and subsequently the above cover sheet was superposed. Further, pods which have about 1.0 ml of content and contains a processing composition as given below were attached therebetween to form a film unit. Then, this film unit was passed through a pair of pressure rollers juxtaposed at the distance of about 340 μm to burst pods and to spread the contents of pods between said light-sensitive element and a cover sheet.

The processing composition used here was as follows:

| | |
|---|---|
| Potassium hydroxide | 56 g |
| Sodium sulfite | 2.0 g |
| 4-Hydroxymethyl-4-methyl-1-pheny-3-pyrazolidone | 8.0 g |
| 5-Methylbenzotriazole | 2.8 g |
| Carbon black (Rever-450: manufactured by Columbian Carbon) | 150 g |
| Carboxy methyl cellulose sodium salt (high viscosity type: manufactured by Tokyo Kasei) | 50.0 g |
| Benzyl alcohol | 1.5 ml |
| Distilled water to make up | 1000.0 ml |

After 3 minutes, the dye image was observed through the transparent support of the light-sensitive element.

Results of the magenta dye image thus obtained are shown in Table 8.

TABLE 8

| | Exemplified Compound | Maximum Density | Minimum Density |
|---|---|---|---|
| 1 | Exemplified compound (1) | 2.58 | 0.23 |
| 2 | Exemplified compound (48) | 2.53 | 0.21 |
| 3 | Exemplified compound (73) | 2.49 | 0.20 |
| Comparative sample | None | 1.43 | 0.22 |

From the above results, it is noted that by the use of the compounds of this invention, excellent diffusion transfer positive image having high maximum density and low minimum density can be formed.

What we claim is:

1. A direct positive photographic material comprising a layer containing an internal latent image type light-sensitive silver halide emulsion that has not been fogged coated on a support, said material containing a compound represented by the general formula (I) or (II):

General formula (I)

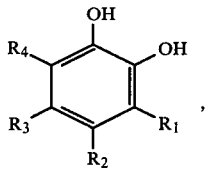

General Formula (II)

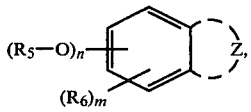

wherein $R_1$ represents a hydrogen atom, a hydroxyl group or an alkyl, alkenyl, alkoxy, acyloxy, aralkyl or aryl group which is substituted or unsubstituted; $R_2$, $R_3$ and $R_4$ each represent a hydrogen atom, a halogen atom, $—SO_2R_7$, $—COR_8$, or an alkyl, alkenyl, alkoxy, aralkyl or aryl group which is substituted or unsubstituted; $R_5$ represents a hydrogen atom, $—COR_7$ or $—SO_2R_7$ and when n is 2 or 3, $R_5$ may be same or different; $R_6$ represents a hydrogen atom, a halogen atom or an alkyl, alkoxy, aryl or alkenyl group which may be substituted, and when m is 2, $R_6$ may be same or different; Z represents an atomic group necessary to complete a 5 to 7-membered alkylene ring, or a chroman or coumaran ring by fusing together with benzene ring, and Z may have a spyro carbon atom; $R_7$ represents a hydroxyl group, or an alkyl, alkoxy, aryloxy or amino group which is substituted or unsubstituted; n is 2 or 3; m is a number obtained by subtracting n from 4; and $R_8$ represents hydrogen atom, hydroxyl group, or an alkyl, alkoxy, aryloxy or amino group which is substituted or unsubstituted, with the proviso that at least one of $R_1$, $R_2$, $R_3$ and $R_4$ is not hydrogen atoms at the same time.

2. A direct positive photographic material according to claim 1 wherein the compound is represented by the general formula [II-1], [II-2], [II-3], [II-4], [II-5], or [II-6]:

General formula [II-1]

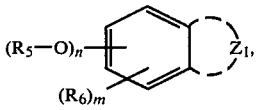

General formula [II-2]

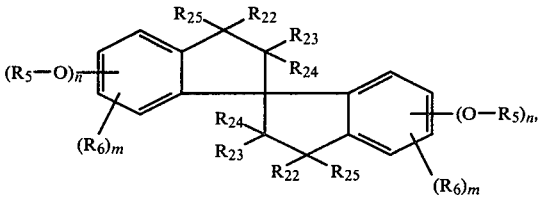

General formula [II-3]

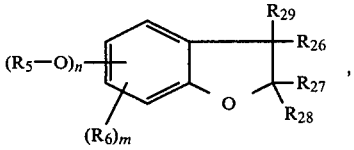

General formula [II-4]

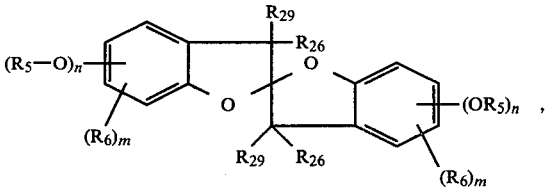

General formula [II-5]

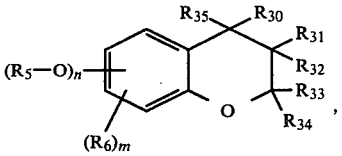

General formula [II-6]

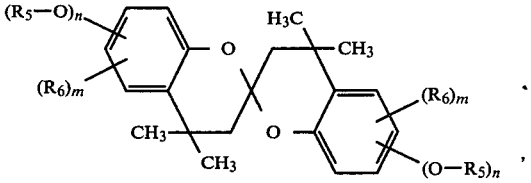

wherein $Z_1$ represent an atomic group necessary to complete a 5 to 7-membered alkylene ring, $R_5$ represents a hydrogen atom, $—COR_7$ or $—SO_2R_7$, $R_6$ represents a hydrogen atom, a halogen atom or an alkyl, alkoxy, aryl or alkenyl group which may be substituted, and when m is 2, $R_6$ may be same or different; $R_7$ represents a hydroxy group, or an alkyl, alkoxy, aryloxy or amino group which is substituted or unsubstituted; $R_{22}$ to $R_{35}$ each represent a hydrogen atom, a halogen atom, or an alkyl or aryl group which may be substituted; n is 2 or 3; and m is a number obtained by subtracting n from 4.

3. A direct positive photographic material according to claim 1 wherein the compound is represented by the general formula [I-1] or [I-2]:

General formula [I-1]

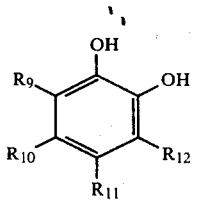

General formula [I-2]

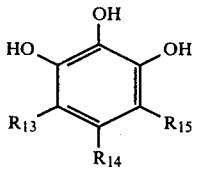

wherein $R_9$ to $R_{15}$ each represent hydrogen atom, a halogen atom, $—SO_2R_7$, $—COR_8$, or an alkyl, alkenyl, alkoxy, aralkyl or aryl group which is substituted or unsubstituted; $R_7$ represents hydroxyl group, or an alkyl, alkoxy, aryloxy or amino group which is substituted or unsubstituted; and $R_8$ represents a hydrogen atom, a hydroxyl group, or an alkyl, alkoxy, aryloxy or amino group which is substituted or unsubstituted, with the proviso that at least one of $R_9$ to $R_{15}$ is not a hydrogen atom.

4. A direct positive photographic material according to claim 1 wherein the compound is represented by the general formula [I-3]:

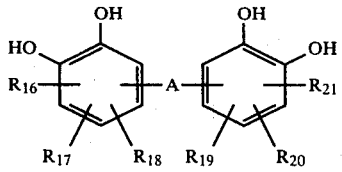

wherein A represents a simple bond or an alkylene group, $R_{16}$ to $R_{21}$ each represent a hydrogen atom, a halogen atom, $—SO_2R_7$, $—COR_8$, or an alkyl, alkenyl, alkoxy, aralkyl or aryl group which is substituted or unsubstituted; $R_7$ represents hydroxyl group, or an alkyl, alkoxy, aryloxy or amino group which is substituted or unsubstituted; and $R_8$ represents hydrogen atom, hydroxyl group, or an alkyl, alkoxy, aryloxy or amino group which is substituted or unsubstituted, with the proviso that at least one of $R_{16}$ to $R_{21}$ is not a hydrogen atom.

5. A direct positive photographic material according to claim 1, further comprising a dye forming coupler.

6. A method for forming a direct positive image comprising effecting surface development after and/or during fogging treatment of an imagewisely exposed direct positive photographic material comprising a layer containing an internal latent image type light-sensitive silver halide emulsion that has not been fogged coated on a support, said material containing a compound represented by the general formula [I] or [II]:

General formula [I]

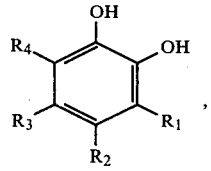

General formula [II]

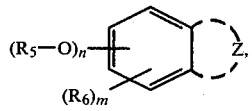

wherein $R_1$ represents a hydrogen atom, a hydroxyl group or an alkyl, alkenyl, alkoxy, acyloxy, aralkyl or aryl group which is substituted or unsubstituted; $R_2$, $R_3$ and $R_4$ each represent a hydrogen atom, a halogen atom, $—SO_2R_7$, $—COR_8$, or an alkyl, alkenyl, alkoxy, aralkyl or aryl group which is substituted or unsubstituted; $R_5$ represents a hydrogen atom, $—COR_7$ or $—SO_2R_7$ and when n is 2 or 3, $R_5$ may be same or different; $R_6$ represents a hydrogen atom, a halogen atom or an alkyl, alkoxy, aryl or alkenyl group which may be substituted, and when m is 2, $R_6$ may be some or different; Z represents an atomic group necessary to complete a 5 to 7-membered alkylene ring, or a chroman or coumaran ring by fusing together with benzene ring, and Z may have a spyro carbon atom; $R_7$ represents a hydroxyl group, or an alkyl, alkoxy, aryloxy or amino group which is substituted or unsubstituted; n is 2 or 3; m is a number obtained by subtracting n from 4; and $R_8$ represents hydrogen atom, hydroxyl group, or an alkyl, alkoxy, aryloxy or amino group which is substituted or unsubstituted, with the proviso that at least one of $R_1$, $R_2$, $R_3$, and $R_4$ is not hydrogen atoms at the same time.

7. A method for forming a direct positive image according to claim 5 wherein the compound is represented by the general formula [II-1], [II-2], [II-3], [II-4], [II-5] or [II-6]:

General formula [II-1]

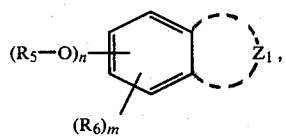

General formula [II-2]

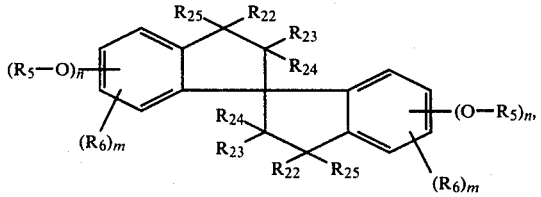

General formula [II-3]

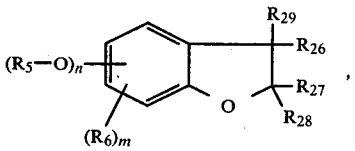

General formula [II-4]

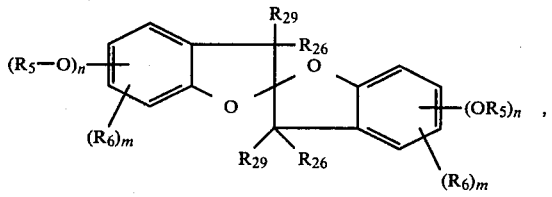

General formula [II-5]

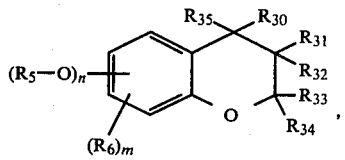

General formula [II-6]

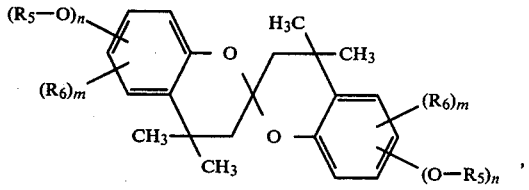

wherein $Z_1$ represent an atomic group necessary to complete a 5 to 7-membered alkylene ring, $R_5$ represents a hydrogen atom, $—COR_7$ or $—SO_2R_7$, $R_6$ represents a hydrogen atom, a halogen atom or an alkyl, alkoxy, aryl or alkenyl group which may be substituted, and when m is 2, $R_6$ may be same or different; $R_7$ represents a hydroxy group, or an alkyl, alkoxy, aryloxy or amino group which is substituted or unsubstituted; $R_{22}$ to $R_{35}$ each represent a hydrogen atom, a halogen atom, or an alkyl or aryl group which may be substituted; n is 2 or 3; and m is a number obtained by subtracting n from 4.

8. A method for forming a direct positive image according to claim 5 wherein the compound is represented by the general formula [I-1] or [I-2]:

General formula [I-1]

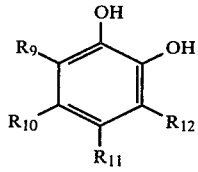

General formula [I-2]

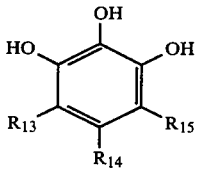

wherein $R_9$ to $R_{15}$ each represent hydrogen atom, a halogen atom, $—SO_2R_7$, $—COR_8$, or an alkyl, alkenyl, alkoxy, aralkyl or aryl group which is substituted or unsubstituted; $R_7$ represents hydroxyl group, or an alkyl, alkoxy, aryloxy or amino group which is substituted or unsubstituted; and $R_8$ represents a hydrogen atom, a hydroxyl group, or an alkyl, alkoxy, aryloxy or amino group which is substituted or unsubstituted, with the proviso that at least one of $R_9$ to $R_{15}$ is not a hydrogen atom.

9. A method for forming a direct positive image according to claim 5 wherein the compound is represented by the general formula [I-3]:

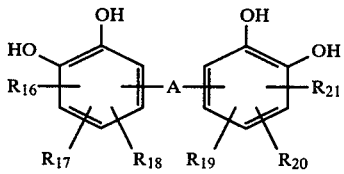

wherein A represents a simple bond or an alkylene group, $R_{16}$ to $R_{21}$ each represent a hydrogen atom, a halogen atom, $—SO_2R_7$, $—COR_8$, or an alkyl, alkenyl, alkoxy, aralkyl or aryl group which is substituted or unsubstituted; $R_7$ represents hydroxyl group, or an alkyl, alkoxy, aryloxy or amino group which is substituted or unsubstituted; and $R_8$ represents hydrogen atom, hydroxyl group, or an alkyl, alkoxy, aryloxy or amino group which is substituted or unsubstituted, with the proviso that at least one of $R_{16}$ to $R_{21}$ is not a hydrogen atom.

* * * * *